US010590735B2

(12) United States Patent
Linklater et al.

(10) Patent No.: US 10,590,735 B2
(45) Date of Patent: Mar. 17, 2020

(54) FISH THROUGH FILTER DEVICE

(71) Applicant: M-I Drilling Fluids UK Ltd., Aberdeen (GB)

(72) Inventors: James Linklater, Buckie (GB); Jonathan Buckland, Aberdeen (GB)

(73) Assignee: M-I Drilling Fluids UK Ltd., Aberdeen (GB)

( * ) Notice: Subject to any disclaimer, the term of this patent is extended or adjusted under 35 U.S.C. 154(b) by 272 days.

(21) Appl. No.: 15/564,735

(22) PCT Filed: Apr. 13, 2016

(86) PCT No.: PCT/US2016/027227
§ 371 (c)(1),
(2) Date: Oct. 5, 2017

(87) PCT Pub. No.: WO2016/168259
PCT Pub. Date: Oct. 20, 2016

(65) Prior Publication Data

US 2018/0119514 A1 May 3, 2018

Related U.S. Application Data

(60) Provisional application No. 62/147,752, filed on Apr. 15, 2015.

(51) Int. Cl.
*E21B 21/00* (2006.01)
*E21B 27/00* (2006.01)
(Continued)

(52) U.S. Cl.
CPC ..... *E21B 34/06* (2013.01); *E21B 21/00* (2013.01); *E21B 21/002* (2013.01); *E21B 27/00* (2013.01);
(Continued)

(58) Field of Classification Search
CPC ..... E21B 27/005; E21B 21/002
See application file for complete search history.

(56) References Cited

U.S. PATENT DOCUMENTS 4,336,850 A 6/1982 Fielder
4,495,073 A 1/1985 Beimgraben
(Continued)

FOREIGN PATENT DOCUMENTS

GB 2500513 A 9/2013
WO 2003/069123 A2 8/2003

OTHER PUBLICATIONS

International Preliminary Report on Patentability for the equivalent International patent application PCT/US2016/027227 dated Oct. 26, 2017.

(Continued)

*Primary Examiner* — Shane Bomar
(74) *Attorney, Agent, or Firm* — Jeffrey D. Frantz

(57) ABSTRACT

A filter device housed within a body component. The filter device can include an outer filter and an inner filter positioned coaxially within the outer filter. The outer and inner filters may be composed of a material having mesh, slots, holes, or any other openings being of a sufficient size and shape to restrict passage of items of a predetermined size or larger. Formed between the inner and outer filters is a first annular space into which fluid that is provided down the drill string may enter. The filter device may also include a valve within the internal bore which regulates passage of wellbore fluid provided to the drill string, or for a wireline or slickline, to pass through the filter device in order to access other components of the drill string downhole from the filter device.

18 Claims, 6 Drawing Sheets

(51) Int. Cl.

| | |
|---|---|
| ***E21B 34/06*** | (2006.01) |
| ***E21B 37/00*** | (2006.01) |
| ***E21B 43/08*** | (2006.01) |
| *E21B 34/00* | (2006.01) |

(52) U.S. Cl.
CPC ..... *E21B 37/00* (2013.01); *E21B 43/08* (2013.01); *E21B 2034/005* (2013.01)

(56) References Cited

U.S. PATENT DOCUMENTS

| | | | | |
|---|---|---|---|---|
| 5,097,914 | A * | 3/1992 | Grotendorst | E21B 43/082 166/264 |
| 5,740,127 | A * | 4/1998 | Van Steenwyk | E21B 47/187 175/40 |
| 6,176,311 | B1 * | 1/2001 | Ryan | E21B 21/002 166/99 |
| 6,598,685 | B1 | 7/2003 | Mashburn | |
| 6,715,570 | B1 * | 4/2004 | Downton | E21B 21/002 175/314 |
| 7,549,486 | B2 | 6/2009 | Mashburn et al. | |
| 2004/0050591 | A1 | 3/2004 | Downton et al. | |
| 2005/0121233 | A1 | 6/2005 | Frith | |
| 2006/0124315 | A1 * | 6/2006 | Frazier | E21B 34/06 166/369 |
| 2006/0213667 | A1 * | 9/2006 | Mashburn | E21B 21/002 166/380 |
| 2009/0056951 | A1 * | 3/2009 | Mosher | E21B 34/063 166/373 |
| 2012/0175111 | A1 | 7/2012 | Mashburn et al. | |
| 2014/0014358 | A1 * | 1/2014 | Leitch | E21B 34/08 166/369 |
| 2014/0231083 | A1 | 8/2014 | Yeh et al. | |
| 2015/0083497 | A1 * | 3/2015 | Mageren | E21B 7/28 175/57 |

OTHER PUBLICATIONS

International Search Report and Written Opinion for the equivalent International patent application PCT/US2016/027227 dated Jul. 26, 2016.

Examination Report for the equivalent Canadian patent application 2982551 dated Apr. 4, 2019.

Examination Report for the equivalent Canadian patent application 2982551 dated Dec. 10, 2019.

* cited by examiner

FISH THROUGH FILTER DEVICE

CROSS REFERENCE TO RELATED APPLICATIONS

This application claims priority from Provisional Patent Application No. 62/147,752, filed Apr. 15, 2015, which is hereby incorporated by reference in its entirety.

BACKGROUND

The use of drilling fluids for the drilling of subterranean boreholes serves numerous purposes, including, for example, suppression of formation pressure, lubrication of the drill string, flushing drill cuttings away from the drill bit, cooling of the bottom hole assembly (BHA), and rotating turbines that provide power for various downhole tools. In general, drilling fluids are pumped down through the drill string to the tools and drill bit and circulate back to the surface via the space between the drill string and the borehole wall known as the annulus. The circulating drilling fluid carries drill cuttings, metal shavings, and other debris to the surface based. It is not uncommon for, various "foreign objects", such as tools, rags, gravel, chunks of plastic from thread protectors, to find their way into the borehole and into the drilling fluid as well. It is desirable to remove these foreign objects and any larger particles, having a size that may damage sensitive downhole tools, such as various measurement while drilling (MWD) or logging while drilling (LWD) tools, or plug drill bit jets during the circulation process.

There are a number of different means for filtering the downhole fluid to remove unwanted particles and debris. One method employs a downhole tool that includes a filter or screen within the drill string above sensitive tools. While effective for maintaining clean drilling fluid, this type of tool generally interferes the ability to pass a wireline downhole of the tool in order to perform an explosive back-off or to retrieve radioactive sources from LWD tools in the event the drill string becomes stuck.

DETAILED DESCRIPTION

Example devices and methods will now be described more fully with reference to the accompanying drawings.

Example devices and methods are provided so that this disclosure will be thorough, and will fully teach and convey the scope to those who are skilled in the art. Numerous specific details are set forth such as examples of specific components, devices, and methods, to provide a thorough understanding of the present disclosure. It will be apparent to those skilled in the art that specific details need not be employed, that example devices and methods may be embodied in many different forms and that neither should be construed to limit the scope or applicability of aspects of the teachings in the disclosure.

The terminology used herein is for the purpose of describing particular example devices and methods only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, components, and/or groups, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Figure 1:
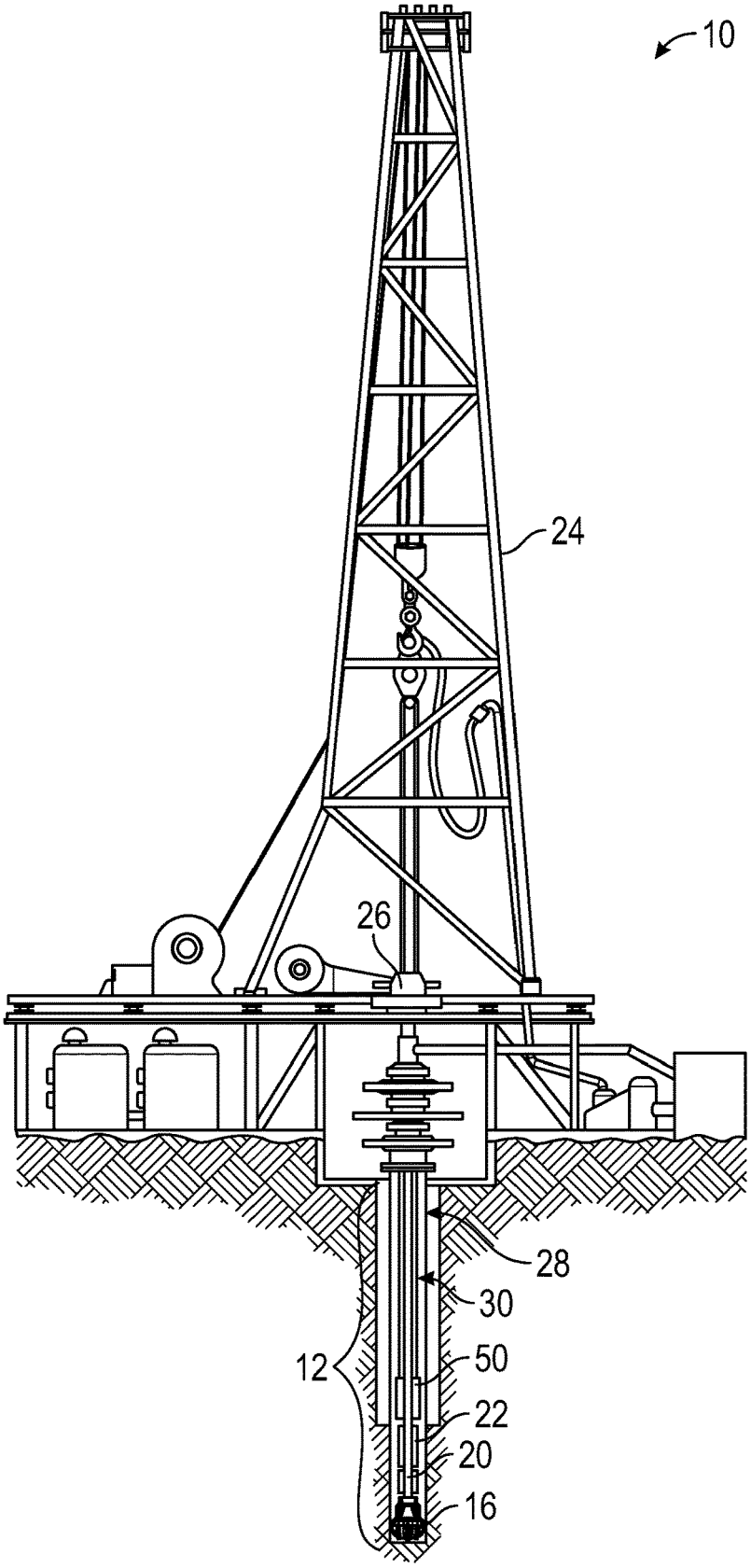
FIG. 1 shows a drilling system, in accordance with disclosed examples.

FIG. 1 shows an example drilling system 10 that may be used with devices and methods disclosed herein. The drilling system 10 can include a drill string 12 having a drill bit 16, a motor 20, monitoring tools 22, and a filter device 50, in various configurations and combinations. The motor 20 is coupled to the drill bit 16 in order to cause rotation of the drill bit 16. The drill string 12 may also include pre-completion tools, such as casing cleaning tools, circulating tools, debris recovery tools and/or liner-top testing tools (not shown). The drill string 12 may be suspended and moved longitudinally by a drilling rig 24 or similar hoisting device having a rotary table 26 or equivalent. The drill string 12 may be assembled from threadably coupled segments ("joints") of drill pipe or other forms of conduit. The drill string 12 may be disposed in a borehole 28 such that an annulus 30 is formed between the drill string 12 and the walls of the borehole 28.

Figure 2:
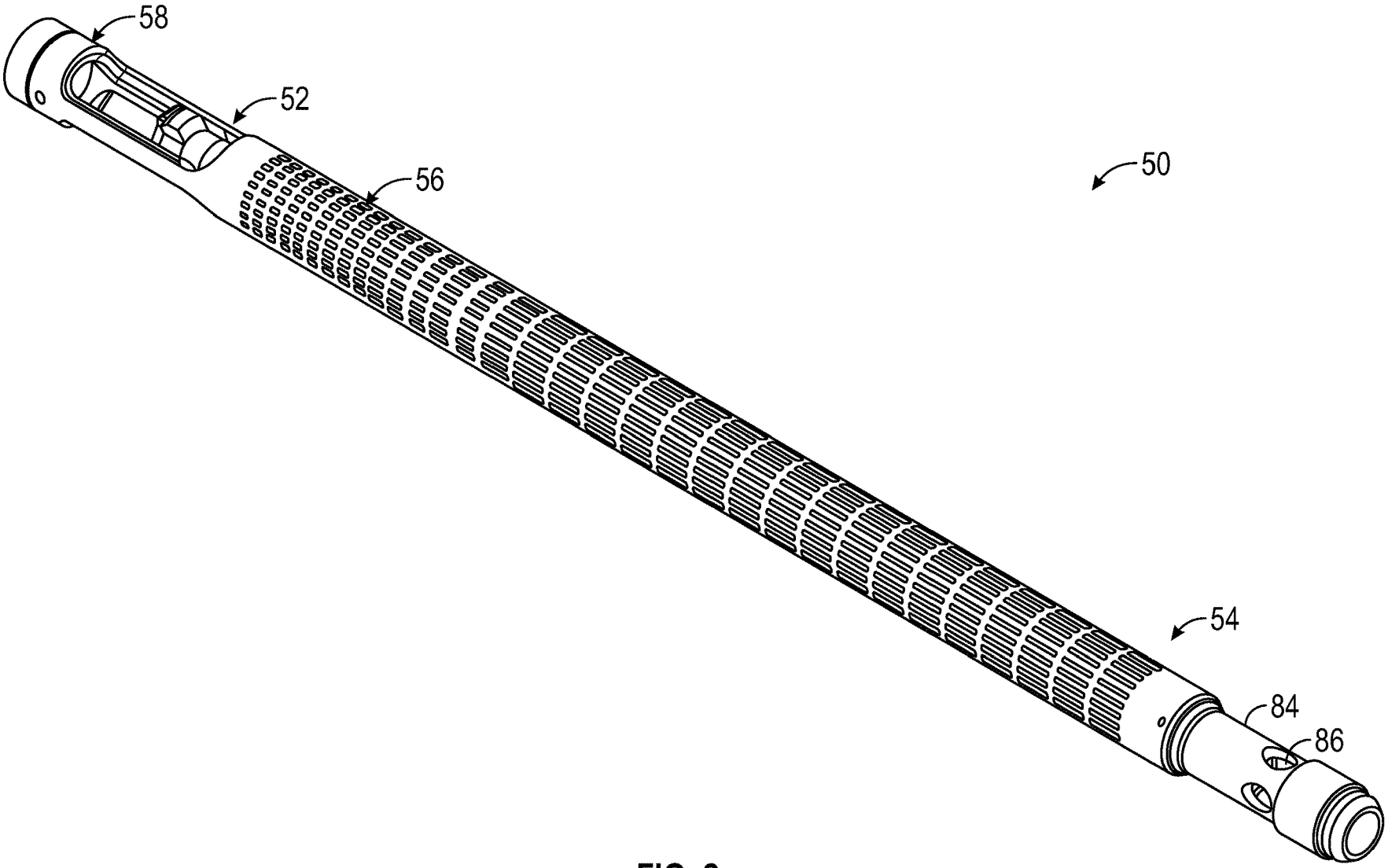
FIG. 2 is an isometric view of a filter device with a cut-out in the distal end showing a valve configuration, in accordance with disclosed examples.

FIG. 2 is an isometric view of a filter device 50 having a cut-out in the distal end of the filter device 50 showing a valve configuration. The distal end 52 of the device 50 will be referred to herein as the upper end as it is the portion of the device 50 that is located up-hole when deployed into a borehole 28. Further, the proximal end 54 will be referred to herein as the lower end as it is the end of the device 50 that is located down-hole when the device is deployed in the borehole 28. The device includes an outer filter 56 which may define the outer diameter of the device and may serve as a housing for other components of the filter device 50. The filter device 50 also includes an upper housing 58 at the upper end 52 of the device when the filter device 50 is deployed in a borehole 28. Note that the upper housing 58 may be configured such that another tool or device can be connected to the filter device 50 in order to retrieve it from inside a body component 51 (shown in FIG. 3) to check the state of the filters and/or clean the filters.

Figure 3:
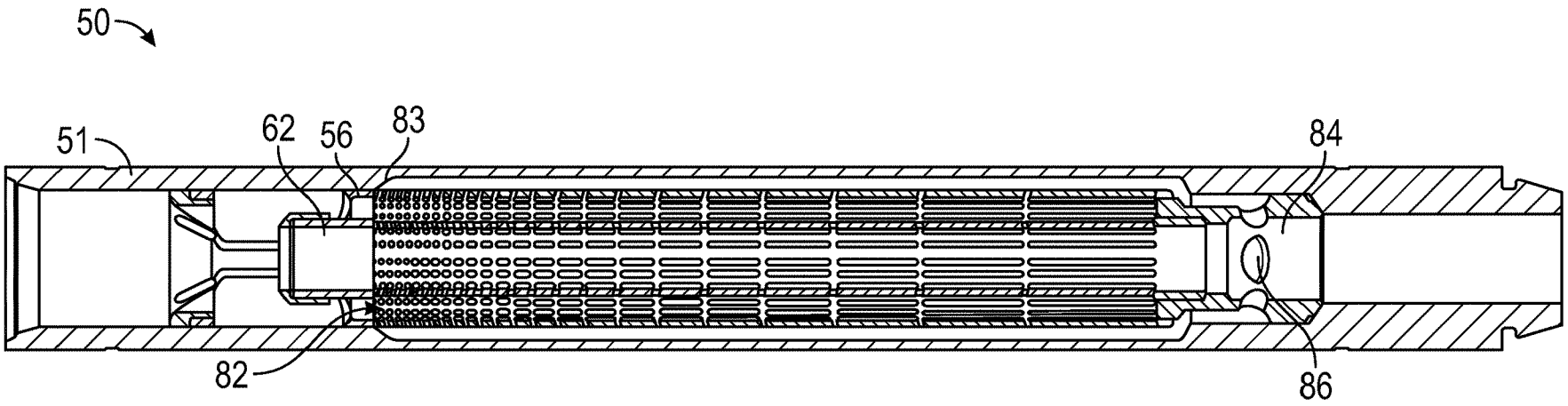
FIG. 3 illustrates a partial cross section view of the filter device housed within a body component, in accordance with disclosed examples.

FIG. 3 illustrates a partial cross section view of the filter device 50 housed within a body component 51. In addition to the outer filter 56, the filter device 50 may include an inner filter 62 positioned coaxially within the outer filter 56. The outer 56 and inner 62 filters may be composed of a material having mesh, slots, holes, or any other openings being of a sufficient size and shape to restrict passage of items of a predetermined size or larger. Formed between the inner 62 and outer filters 56 is a first annular space 82 into which fluid that is provided down the drill string may enter. In addition, there is a second annular space 83 between the outer filter 56 and the body component 51 into which fluid that has passed through the outer filter 56 may enter. The filter device 50 may also include a ported sub 84 located at the lower end 54 of the device which is isolated from fluid communication with the first annular space 82, but open to fluid communication from the second annular space 83 via inlets 86.

Figure 4:
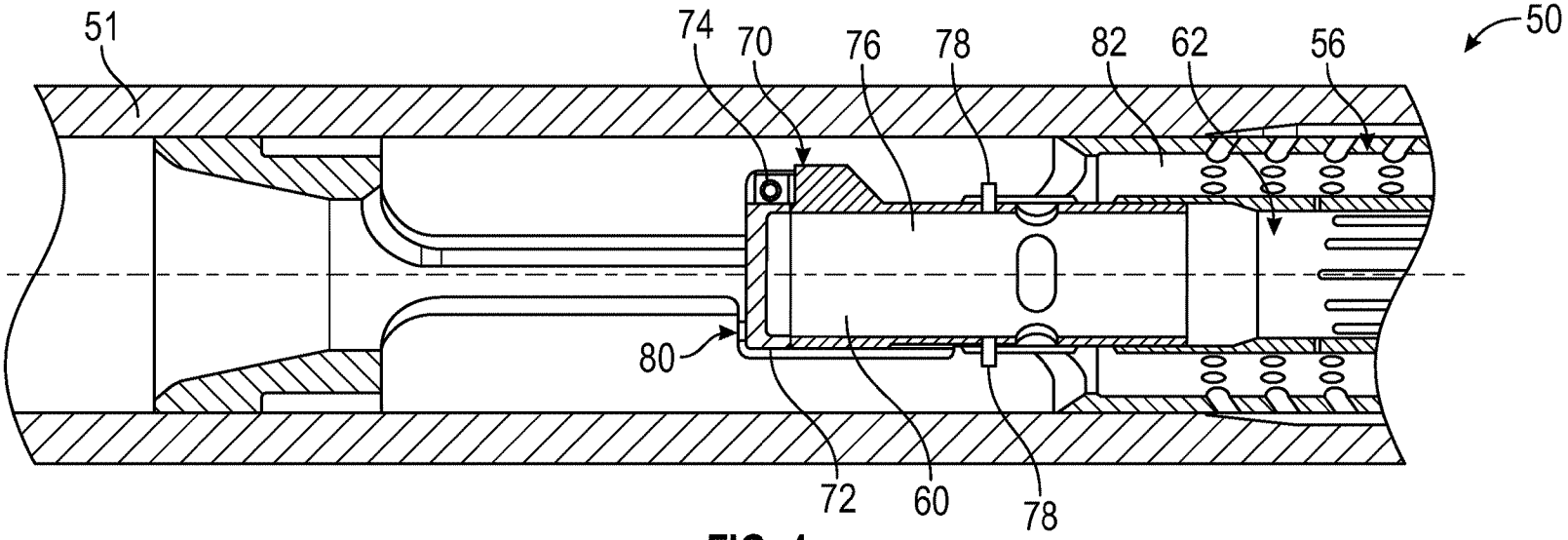
FIG. 4 illustrates a cross section view of the upper end of the filter device, in accordance with disclosed examples.

FIG. 4 illustrates a cross section view of the upper end 52 of the filter device 50. The filter device 50 may be housed in a body component 51 and run downhole as part of a drill string 12. The filter device 50 has an internal bore 60 having a diameter defined, in part, by the internal diameter of an inner filter 62. The internal bore 60 provides a passageway for wellbore fluid provided to the drill string, or for a wireline or slickline, to pass through the filter device 50 in order to access other components of the drill string downhole from the filter device 50. While examples herein are described with respect to a wireline or slickline, one having ordinary skill in the art will recognize that other cable-type devices may also be utilized.

FIG. 4 also illustrates a valve 70 being located within the upper housing 58, proximate to the inner filter 62 and configured so as to obstruct flow of fluid to the internal bore 60 when in a closed position. In an embodiment, the valve 70 is provided as hinged valve assembly including, but not limited to, a flap 72, a spring 74, a sleeve 76 and securing means 78, such as shearable pins. Within the upper housing 58 is a shoulder area 80 that prevents the flap 72 from opening when the valve 70 is in the closed position (i.e., the flap 72 is positioned perpendicular to the internal bore 60). The flap 72 may be connected to the sleeve 76 by a spring 74 configured to exert force on the flap 72 such that it is held against the shoulder area 80, thus obstructing the internal bore 60. When the valve 70 is closed, fluid being provided down the drill string 12 is diverted around the valve 70 and into a first annular space 82 between the inner filter 62 and outer filter 56. The first annular space 82 is closed at the lower end 54 of the device such that the fluid that enters the annular space 82 is then forced outward through the outer filter 56 or inward through the inner filter 62 into the internal bore 60, creating two streams of fluid which have both been filtered. These two streams of filtered fluid may be reunited at the lower end 54 of the device at the ported sub 84. The multiple inlets 86 of the bottom sub 84 allow the fluid that was forced through the outer filter 56 into the internal bore 60 of the device 50 below the closure of the first annular space 82. This allows the filtered fluid to continue through the drill string 12 to the other tools below the filter device 50.

Figure 5:
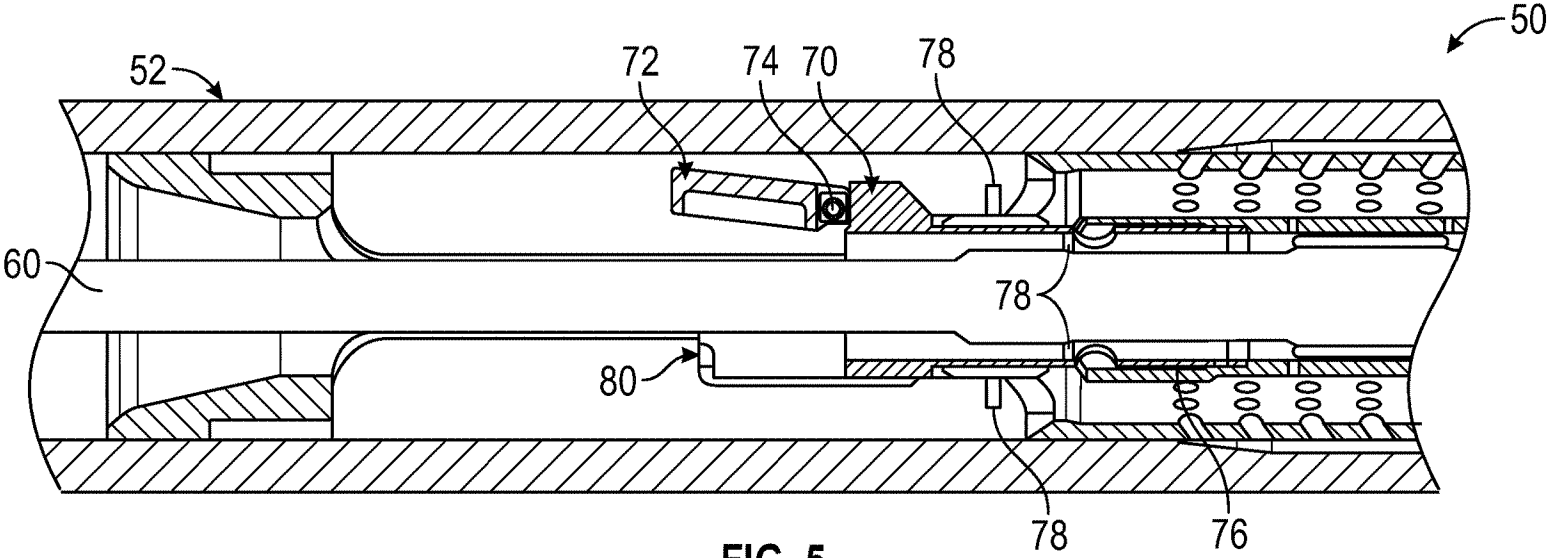
FIG. 5 illustrates a cross section of the filter device showing the valve in a fully open position, in accordance with disclosed examples.

FIG. 5 illustrates a cross section of the filter device 50 showing the valve 70 in a fully open position (i.e., the flap 72 is parallel to the internal bore 60). The valve 70 may be opened by applying sufficient force to cause the securing means 78 to release (e.g., the shearable pins to shear) which allows the sleeve 76, along with the flap 72 and spring 74, to move downward away from the upper end 52 of the device and away from the shoulder area 80. Due to the force that the spring 74 exerts on the flap 72, the flap 72 will swing upwards toward the upper end 52 of the device as the sleeve 76 moves downward. Once the sleeve 76 has moved downward such that the flap 72 is no longer in contact with the shoulder area 80, the valve 70 will be forced into a fully open position by the spring 74 and the internal bore 60 will no longer be obstructed by the flap 72. With the valve 70 in the open position, fluid may flow through the internal bore 60 of the filter device 50, bypassing the annular space 82 between the inner 62 and outer 56 filters (i.e., the fluid is not filtered). Also, when the valve 70 is in the open position, other items or tools having a diameter smaller than that of the internal bore 60, such as a wireline, may pass through the filter device 50 to reach other tools/devices downhole.

Figure 6:
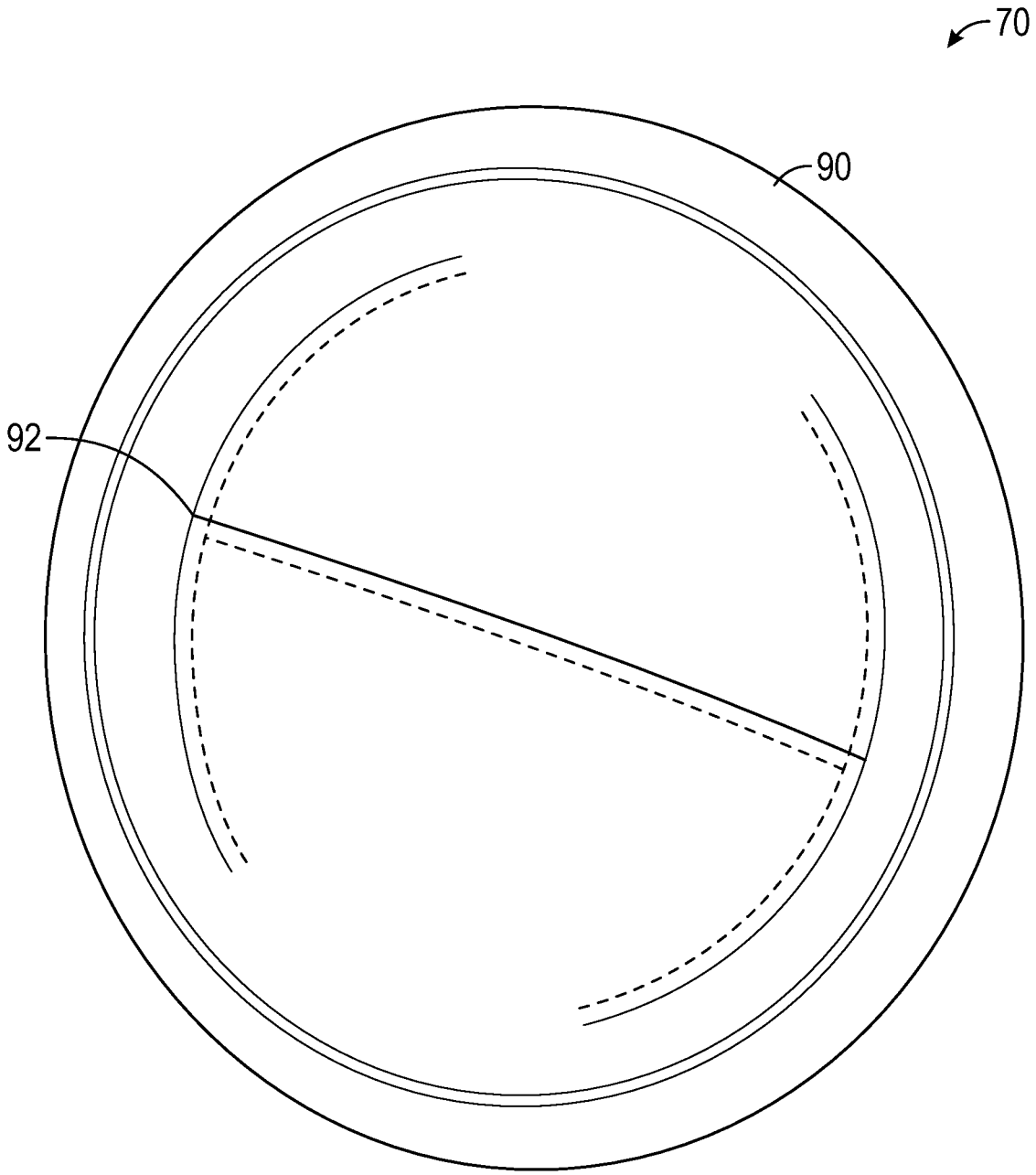
FIG. 6 illustrates a valve configuration, in accordance with the disclosed examples.

The valve 70 illustrated in FIGS. 4 and 5 is described herein for exemplary purposes only. Other valve type devices may be employed within or as part of the filter device 50 so as to create a reversible obstruction of the internal bore. For example, FIG. 6 illustrates an alternate valve 70 that may be provided at the upper end 52 of the filter device 50 so as to prevent fluid flow through the internal bore 60 when in a closed position. The punch-through valve may be configured as a disc 90 having a diameter at least equal to or greater than the diameter of the internal bore and having scored breakage lines 92 provided thereon such that when sufficient force is applied to the disc, the material breaks or separates along the scored breakage lines 92. The scored breakage lines 92 function to ensure the disc 90 fails in a predictable and controlled manner and are also configured such that the pieces remain attached to one another to avoid providing debris downhole of the filter device 50. Once the disc 90 has failed, it no longer obstructs the internal bore 60 as the pieces are moved out of the flow path and fluid and/or a tool may pass downhole through the filter device 50.

Figure 7:
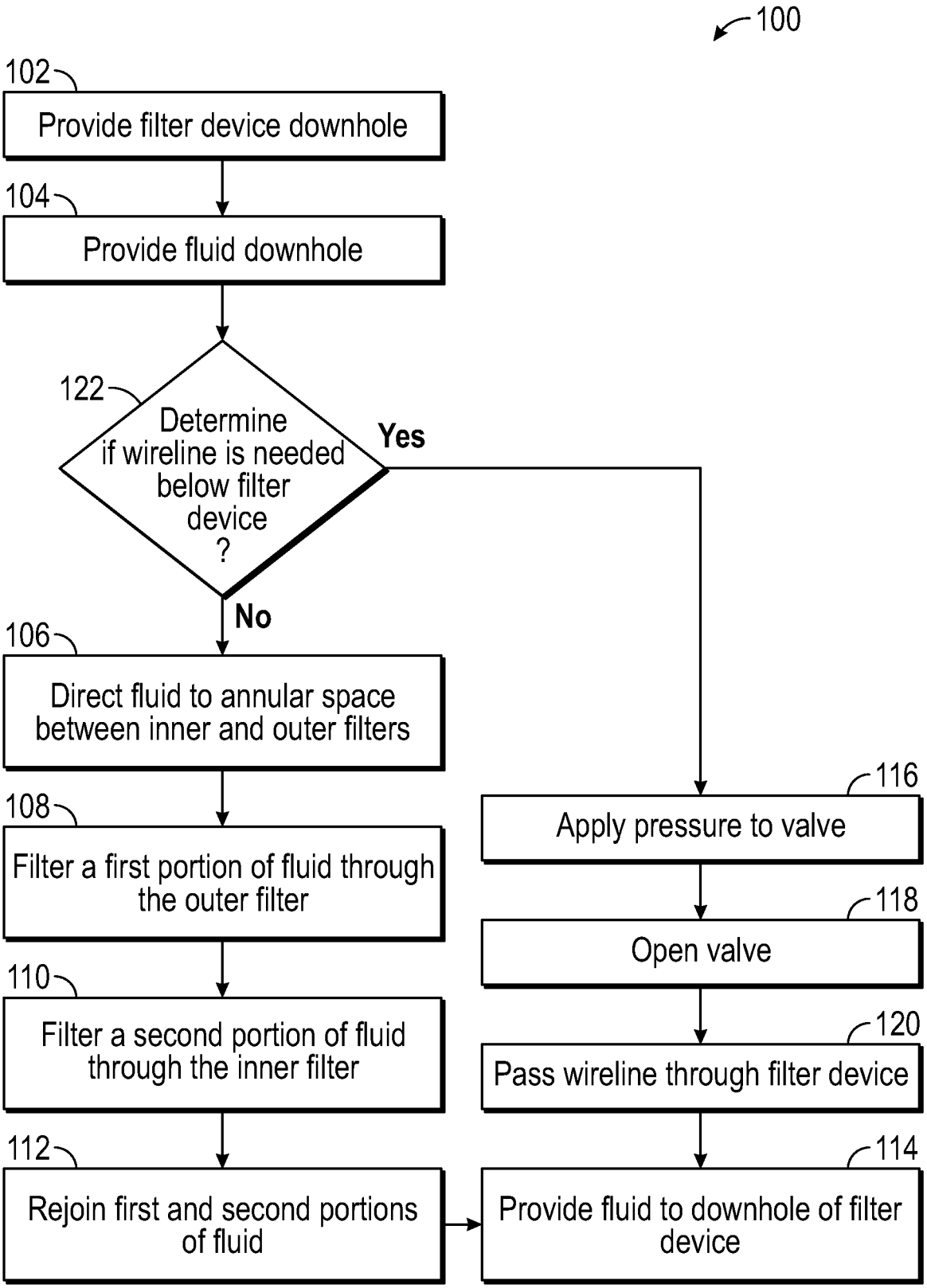
FIG. 7 illustrates a method of passing a wireline or slickline through a filter device located within a borehole, in accordance with disclosed examples.

FIG. 7 illustrates a method 100 of passing a wireline or slickline through a filter device 50 located within a borehole 28. The filter device 50 is provided down a borehole, along with other components of a drill string 12 (102). Generally, the filter device 50 would be provided downhole with the valve 70 in the closed position. Fluid may then be provided, for example, by pumping, down the drill string 12 to a filter device 50 (104). The fluid is then directed into the first annular space 82 between the internal 62 and outer 56 filters (106) where a first portion of the fluid is forced through the outer filter 56 (108) into a second annular space 83 and a second portion of the fluid is forced through the inner filter 62 (110) into the internal bore 60. The first and second portions of filtered fluid continue downhole where the first portion of fluid may be directed into the internal bore 60 through inlets 86 in a bottom sub 84 (112) such that it joins the second portion of fluid and may continue down the drill string 12 to other tools located below the filter device 50 (114). It may become necessary at any point in the drilling process to provide a wireline or slickline down the borehole 28 for a variety of reasons, such as to retrieve radioactive sources from Logging While Drilling (LWD) tools or to perform an explosive backoff if the drill string 12 becomes stuck. If it is determined that a wireline or slickline tool is required below the filter device 50 (122), sufficient force may be applied to the valve 70 of the filter device 50 (116) to cause it to open. Force upon the valve 70 may be provided by contacting the valve 70 with a wireline or slickline in order to release securing means 78 or rupture the disc 90 along the breakage lines 92. Force may also be exerted on the valve 70 by increasing the pressure at which fluid is pumped down the drill string 12 or by virtue of pressure buildup due to clogging of the inner 62 and/or outer 56 filters. Upon opening of the valve 70 (i.e., removing the obstruction from the internal bore 60) (118), the wireline or slickline may be passed through the filter device 50 (120) without having to bring the wireline or slickline to the surface. This can provide time savings to drilling operators by eliminating the need for multiple trips downhole to first retrieve a cap or plug from a filter type device and then to provide the wireline or slickline downhole a second time to remedy a stuck drill string or retrieve radioactive material.

Although only a few example embodiments have been described in detail above, those skilled in the art will readily appreciate that many modifications are possible in the example embodiments without materially departing from this invention. Accordingly, such modifications are intended to be included within the scope of this disclosure as defined in the following claims. Moreover, embodiments disclosed herein may be practiced in the absence of any element which is not specifically disclosed.

What is claimed is:

1. A device comprising:

an outer filter;

an inner filter axially positioned within the outer filter such that a first annular space is formed between the inner filter and outer filter;

an internal bore defined, in part, by the inner filter; and a valve operably connected to the inner filter, the valve configured to obstruct the internal bore when in a closed position and to permit the passage of a wireline through the internal bore of the device when the valve is in an open position and the internal bore is unobstructed, wherein the device is configured to filter a first portion of drilling fluid through the outer filter when the valve is in the closed position.

2. The device of claim 1 further comprising a body component housing the outer filter such that a second annular space is formed between the body component and the outer filter.

3. The device of claim 2 further comprising a ported sub operably connected to the outer filter.

4. The device of claim 3 wherein the ported sub is in fluid communication with the second annular space.

5. The device of claim 1 further comprising a shoulder area within the inner filter.

6. The device of claim 1 wherein the valve is a hinged valve assembly.

7. The device of claim 1 wherein the valve is a punch-through valve.

8. A method comprising:

providing a filter device down a borehole as part of a drill string, wherein the filter device includes a valve in a closed position such that it obstructs an internal bore of the filter device, and an inner filter axially positioned within an outer filter such that an annular space is formed between the inner filter and the outer filter, the inner filter defining in part the internal bore;

providing drilling fluid to the drill string;

filtering a first portion of drilling fluid through the outer filter when the valve is in the closed position;

applying force to the valve in order to open the valve such that the internal bore is unobstructed; and passing a wireline through the filter device via the unobstructed internal bore.

9. The method of claim 8 further comprising filtering a second portion of drilling fluid through the inner filter when the valve is in the closed position.

10. The method of claim 8 further comprising bypassing the inner and outer filters when the valve is open.

11. A system comprising:

a drill string including a filter device deployed into a borehole, wherein the filter device comprises an outer filter;

an inner filter axially positioned within the outer filter;

an internal bore defined in part by the inner filter; and a valve operably connected to the inner filter and configured to regulate passage of drilling fluid through the internal bore, wherein the internal bore is obstructed when the valve is in a closed position, wherein the internal bore is unobstructed when the valve is in an open position, and wherein the filter device is configured to filter a first portion of drilling fluid through the outer filter when the valve is in the closed position; and a cable-type device configured to exert a sufficient force upon the valve such that it opens to allow the cable-type device to enter the unobstructed internal bore.

12. The system of claim 11 wherein the valve is a hinged valve assembly.

13. The system of claim 12 wherein the hinged valve assembly comprises a flap operably connected to a sleeve by a spring, wherein the sleeve is secured in place by shearable pins.

14. The system of claim 11 wherein the valve is a punch-through valve.

15. The system of claim 14 wherein the punch-through valve includes scored breakage lines configured such that when the valve is opened, pieces remain attached to one another.

16. The system of claim 14 wherein the punch-through valve has a diameter equal to or greater than the internal bore of the filter device.

17. The device of claim 1, wherein the device is further configured to filter a second portion of drilling fluid through the inner filter when the valve is in the closed position.

18. The system of claim 11, wherein the filter device is further configured to filter a second portion of drilling fluid through the inner filter when the valve is in the closed position.

* * * * *